US005291247A

United States Patent [19]

DeCecca

[11] Patent Number: 5,291,247

[45] Date of Patent: Mar. 1, 1994

[54] IMAGE FORMING APPARATUS HAVING A CORONA VENTILATING MEANS

[75] Inventor: Michael L. DeCecca, Fairport, N.Y.

[73] Assignee: Eastman Kodak Company, Rochester, N.Y.

[21] Appl. No.: 939,338

[22] Filed: Sep. 2, 1992

[51] Int. Cl.[5] ..... G03G 21/00

[52] U.S. Cl. ..... 355/215; 204/176; 355/221; 361/229

[58] Field of Search ..... 355/215, 221, 219, 229, 355/228; 361/229, 230, 225; 204/176; 55/103, 124

[56] References Cited

U.S. PATENT DOCUMENTS

| | | | |
|---|---|---|---|
| 4,620,235 | 4/1981 | Stack | 355/3 CH |
| 4,720,727 | 1/1988 | Yoshida | 355/3 R |
| 4,809,027 | 2/1989 | Boyer et al. | 346/159 |
| 5,087,939 | 2/1992 | McDougal | 355/200 |
| 5,170,211 | 12/1992 | Haupt et al. | 355/215 |
| 5,624,685 | 6/1991 | Torok et al. | 55/117 |

FOREIGN PATENT DOCUMENTS

| | | | |
|---|---|---|---|
| 2553692 | 8/1976 | Fed. Rep. of Germany | 355/215 |
| 0461406 | 2/1975 | U.S.S.R. | 355/215 |

*Primary Examiner*—A. T. Grimley
*Assistant Examiner*—T. A. Dang
*Attorney, Agent, or Firm*—Leonard W. Teeash

[57] ABSTRACT

A charger or other corona generating source in an image forming apparatus is ventilated by free convection. A corona charger includes a shield partially enclosing it. The shield includes an opening into an air channel, which air channel includes a portion which has an upward or vertical direction. Air in the vertical portion of the channel is heated, which causes the air to rise to an exit followed by air through the opening in the shield to ventilate the charger.

7 Claims, 5 Drawing Sheets

IMAGE FORMING APPARATUS HAVING A CORONA VENTILATING MEANS

This invention relates to an image forming apparatus of the type including a source of corona. For example, it includes but is not limited to electrostatic image forming apparatus in which electrostatic images are formed, transferred or otherwise treated with corona.

Electrophotographic image forming apparatus commonly use one or more sources of corona. For example, a primary charger can be used to create a uniform electrostatic charge on an image member which can later be dissipated by light to form an electrostatic image. Corona chargers are also used to transfer toner images and to clean an image member as well as to control charges on receiving sheets in such apparatus.

Typical corona chargers include one or more charging wires partially surrounded by a metallic shield. The use of a high voltage corona has a tendency to create substantial ozone in the vicinity of the charging wire, which ozone can react with materials associated with the shield and the wire to cause damage to the charger and possible damage to an image member or other portions of the equipment in the vicinity. At present it is known to ventilate the chargers to remove the ozone and other impurities using blowers and fans. Since the ozone has a tendency to accumulate even after the apparatus is shut off, the fans are commonly left blowing for a period of time after the apparatus is turned off. For a mid to high volume copier or printer, such programming is not impractical and generally solves the problem of residual ozone and acids formed by the ozone that are created after shutdown. However, in smaller, for example, desktop type apparatus, it is not necessarily practical to have electrical components that continue to operate after power is turned off.

U.S. Pat. No. 4,720,727 shows a fan used to circulate heat from a fuser around a charger.

U.S. Pat. No. 4,260,235 shows a particular air channeling structure in which air associated with a rotating drum is moved across a charger to remove ozone.

U.S. Pat. No. 5,087,939 is typical of a number of patents which show the use of an image member cartridge for providing and replacing an image member such as a photoconductive drum in a desktop imaging apparatus. Such structures generally include at least a photoconductive drum or other similar image member, a charger and a cleaning device. Positioning the charger within an image member cartridge creates its own special difficulties in providing proper ventilation for the charger.

SUMMARY OF THE INVENTION

It is an object of the invention to provide an image forming apparatus of the type which uses a corona generating source with an improved means for ventilating the corona source.

This and other objects are accomplished by an image forming apparatus which includes means defining an air channel from an opening to the corona generating source to an exit location. The channel is shaped to define a path for air from the opening to the exit, which path has a portion that has a generally upward direction. A heating means is positioned to heat air in the portion of the channel having the upward direction to cause movement of air from the opening to the exit to ventilate the corona source.

According to a preferred embodiment, the heating means includes a thermal storage medium having high specific heat. It also includes means for heating the thermal storage medium. The high specific heat of the thermal storage medium causes that medium to retain its heat for a substantial time after the heating means has been turned off, thereby providing ventilation after power may have been cut off to the image forming apparatus. With the proper choice of thermal storage medium and geometric design, ventilation can be provided for an hour or longer after the apparatus has been turned off.

According to another preferred embodiment, the charger is included in an image member cartridge and includes a cartridge channel which is positioned upon receipt by the image forming apparatus to mate with a receiving apparatus channel which includes the thermal storage medium. Thus, it is a further object of the invention to provide an image forming apparatus having an image member cartridge in which a corona generating source in the cartridge is ventilated. It is also a further object of the invention to provide a cartridge usable in such an image forming apparatus.

DISCLOSURE OF THE PREFERRED EMBODIMENTS

Although this invention is particularly usable in desktop image forming apparatus in which an image member is receivable in a cartridge, which cartridge also includes a corona generating source as its primary charger, it can be used in any image forming apparatus in which a corona generating source is used. It is illustrated in the FIGS. with respect to the corona generating source used as the primary charger in an image forming apparatus. However, other chargers are used in such apparatus and also benefit from proper ventilation and, thus, can use the invention.

Figure 1:
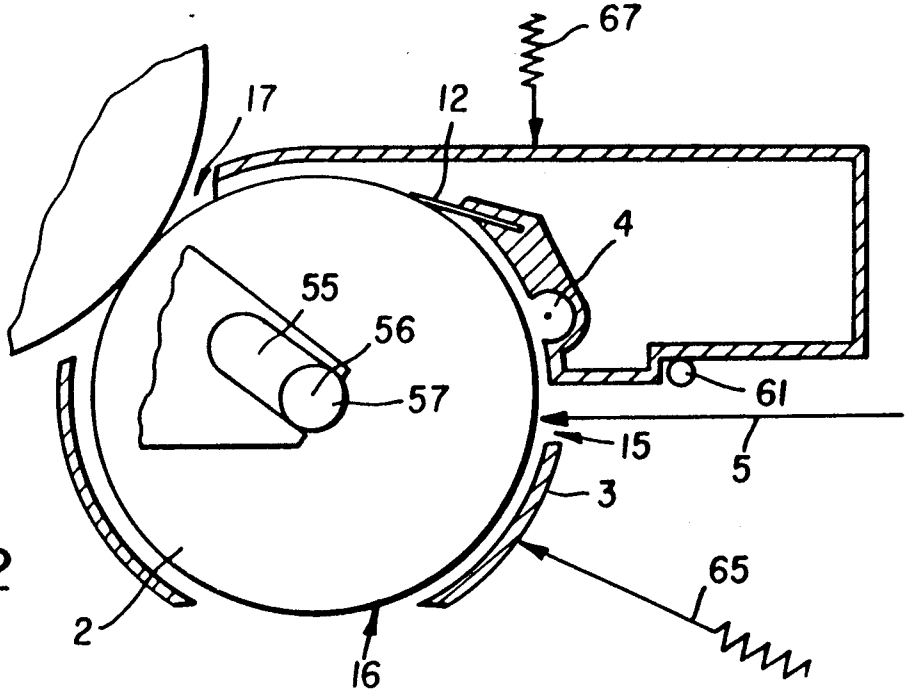
FIG. 1 is a perspective schematic of an image forming apparatus in which the invention is usable.

According to FIG. 1, an image forming apparatus 1 includes an image member, for example, a photoconductive drum 2 which is rotated by means, not shown, to bring its periphery past a series of stations to create multicolor toner images. More specifically, photoconductive drum 2 is rotated past a primary charger 4 which uniformly charges the surface of drum 2. The uniformly charged surface is imagewise exposed by a laser 5 to create a series of electrostatic images thereon. The electrostatic images are toned by application of toner by one of four toning stations contained in a development module 6. Each of the electrostatic images is toned with a toner of a different color utilizing a different one of the toning stations in module 6, to create a series of different color toner images. The toner images are transferred in registration to the surface of a transfer drum 10, creating a multicolor image thereon. The multicolor image is transferred to a receiving sheet fed from a receiving sheet supply 45 to a transfer station 21 which includes a transfer corona generating source. The receiving sheet with the multicolor image transferred to it is then fed to a fuser 23 where the multicolor image is fixed to the sheet, from where it is then transported to an output hopper 44. The photoconductive drum 2 is cleaned by a blade cleaning device 12. The transfer drum 10 is also cleaned by an articulatable cleaning device 30.

Figure 2:
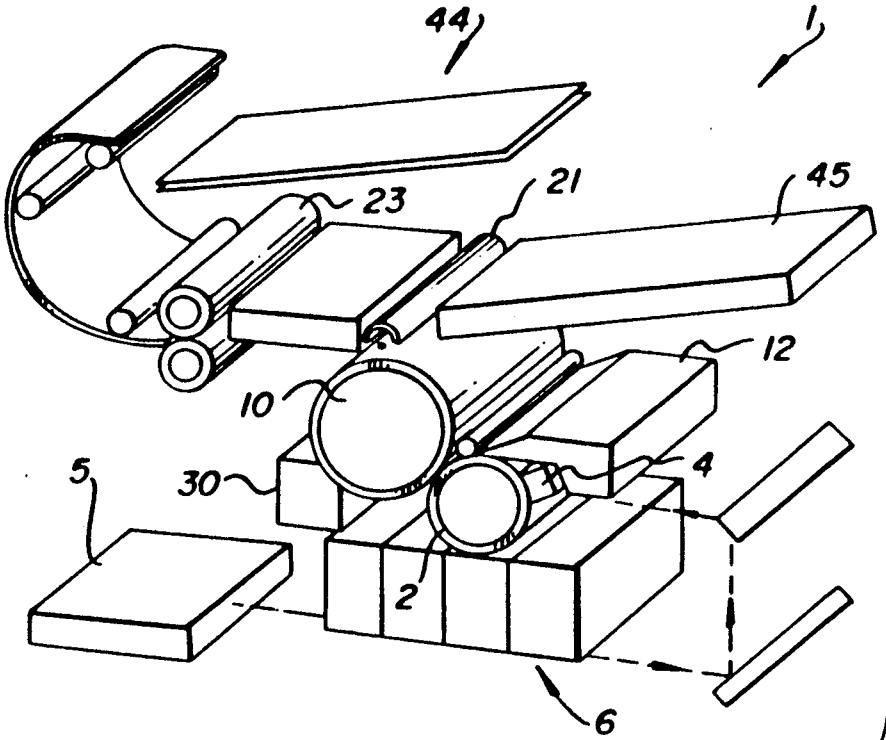
FIG. 2 is a schematic front section of a portion of the image forming apparatus shown in FIG. 1.

For convenience in replacing drum 2 when it becomes worn out and also for replacing other consumable components, image member 2 is mounted in image forming apparatus 1 in a cartridge 3 shown schematically in FIG. 2. According to FIG. 2, cartridge 3 includes an opening 15 through which laser 5 exposes drum 2 and an opening 16 through which electrostatic images are developed and an opening 17 through which they are transferred. It also includes the corona generating device or charger 4 and cleaning blade 12, which cleaning blade separates residual toner from drum 2 and deposits it in a suitable chamber. Cartridge 3 is mounted in the apparatus by an operator utilizing extensions 57 on a shaft 56 for drum 2 which fit in a guide 55 in the receiving apparatus. Springs 65 and 67 hold the cartridge in a position with drum 2 urged against transfer drum 10 and the cartridge, in general, rotated around shaft 56 against a stop 61. For further details with respect to the mounting of cartridge 3, see U.S. Pat. No. 5,087,939, referred to above.

Because of the creation of ozone and, in turn, the reaction of ozone with materials in the corona generating source area, it has long been known that it is desirable to ventilate chargers. This is particularly the case with the fairly high powered charger generally used as the primary charger in an image forming apparatus generally of the type shown in these FIGS. Accordingly, fans and other blowing devices have commonly been used to provide such ventilation, using appropriate openings and the like, associated with the charger. However, it is important to ventilate the charger after the image forming apparatus is turned off. This requires a separate power and timed shutoff for the fan.

Figure 3:
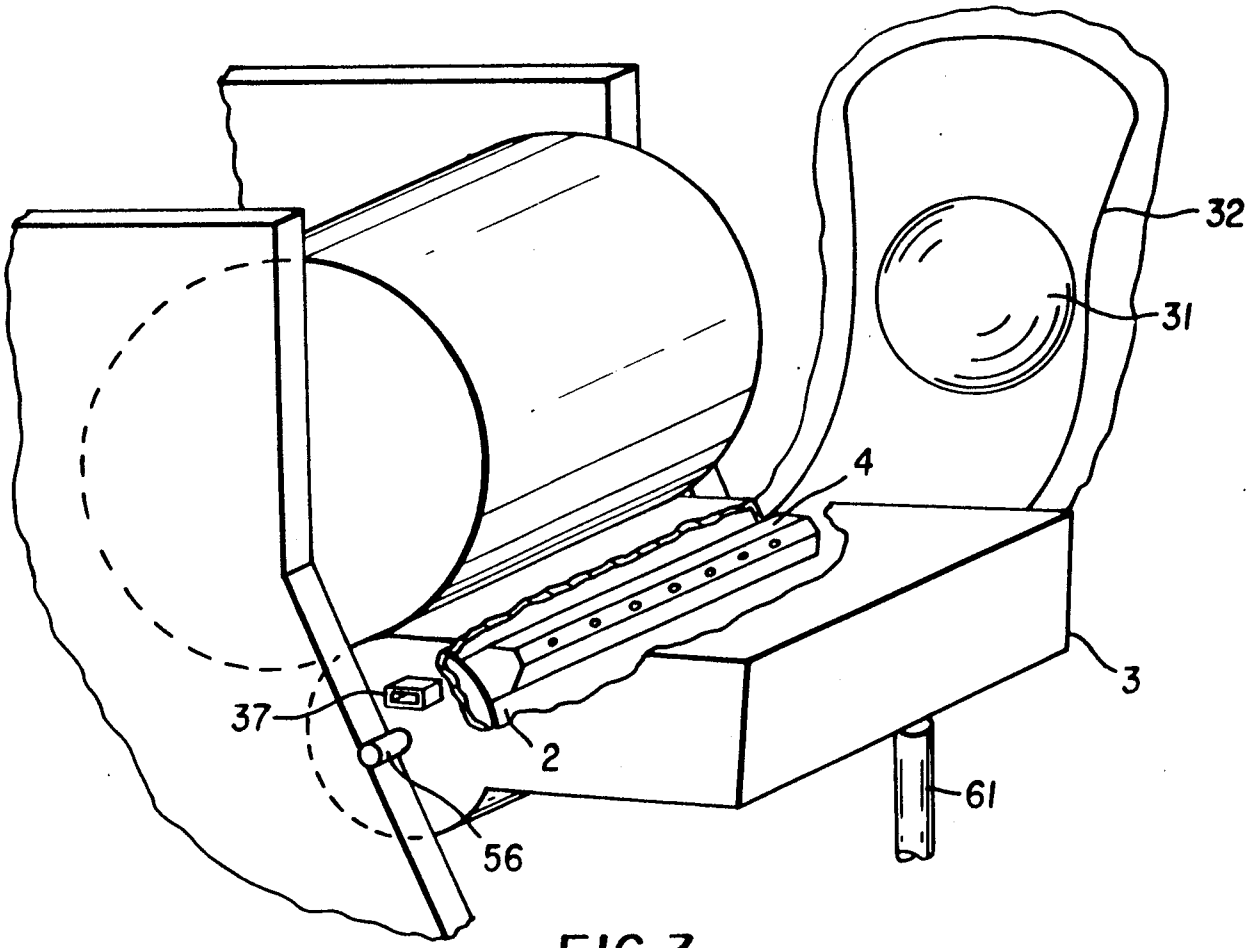
FIG. 3 is a perspective view of the portion of the apparatus shown in FIG. 2 with portions cut away for clarity of illustration.
Figure 4:
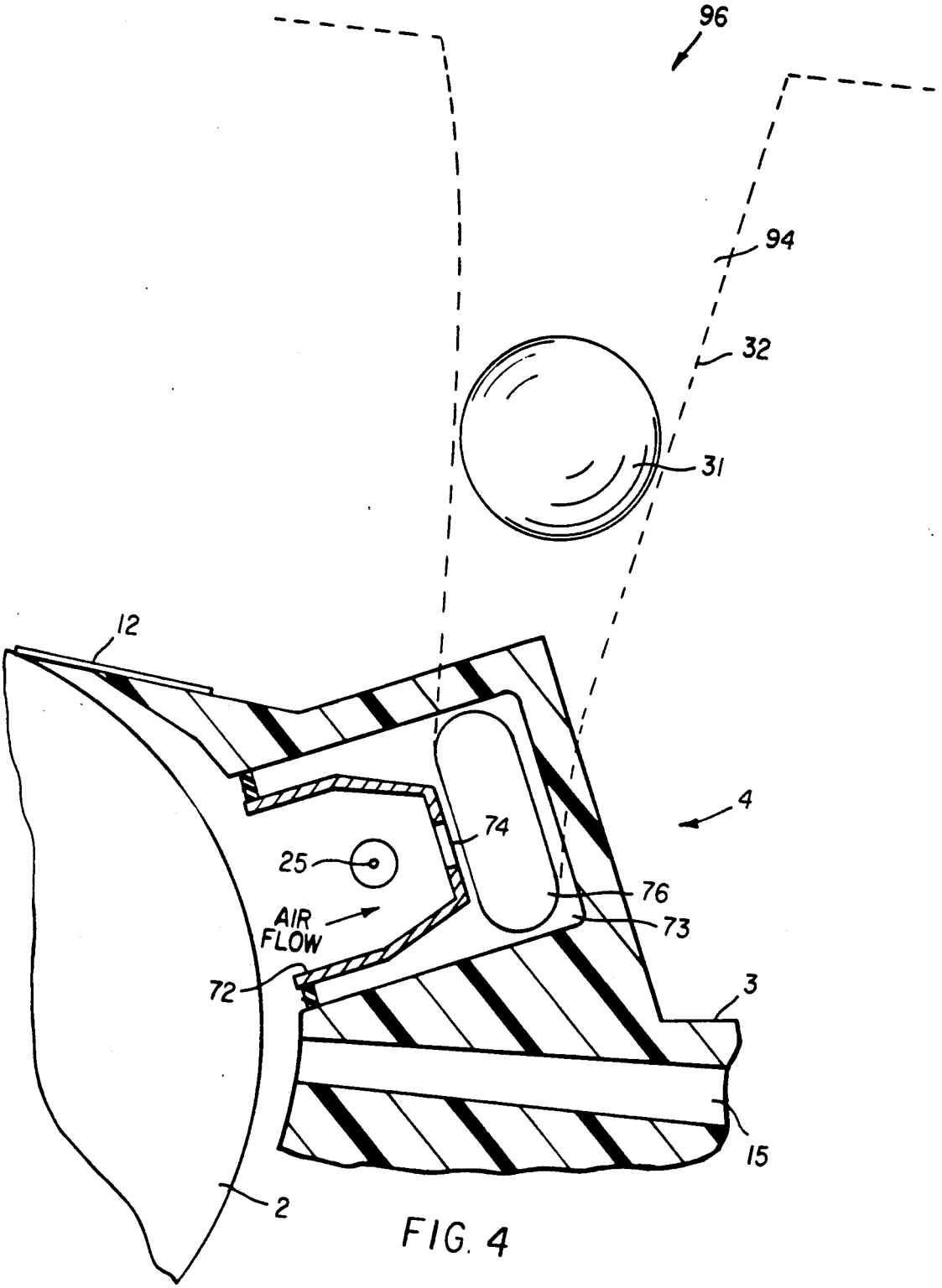
FIG. 4 is a front section of a charger portion of the apparatus shown in FIG. 2.
Figure 5:
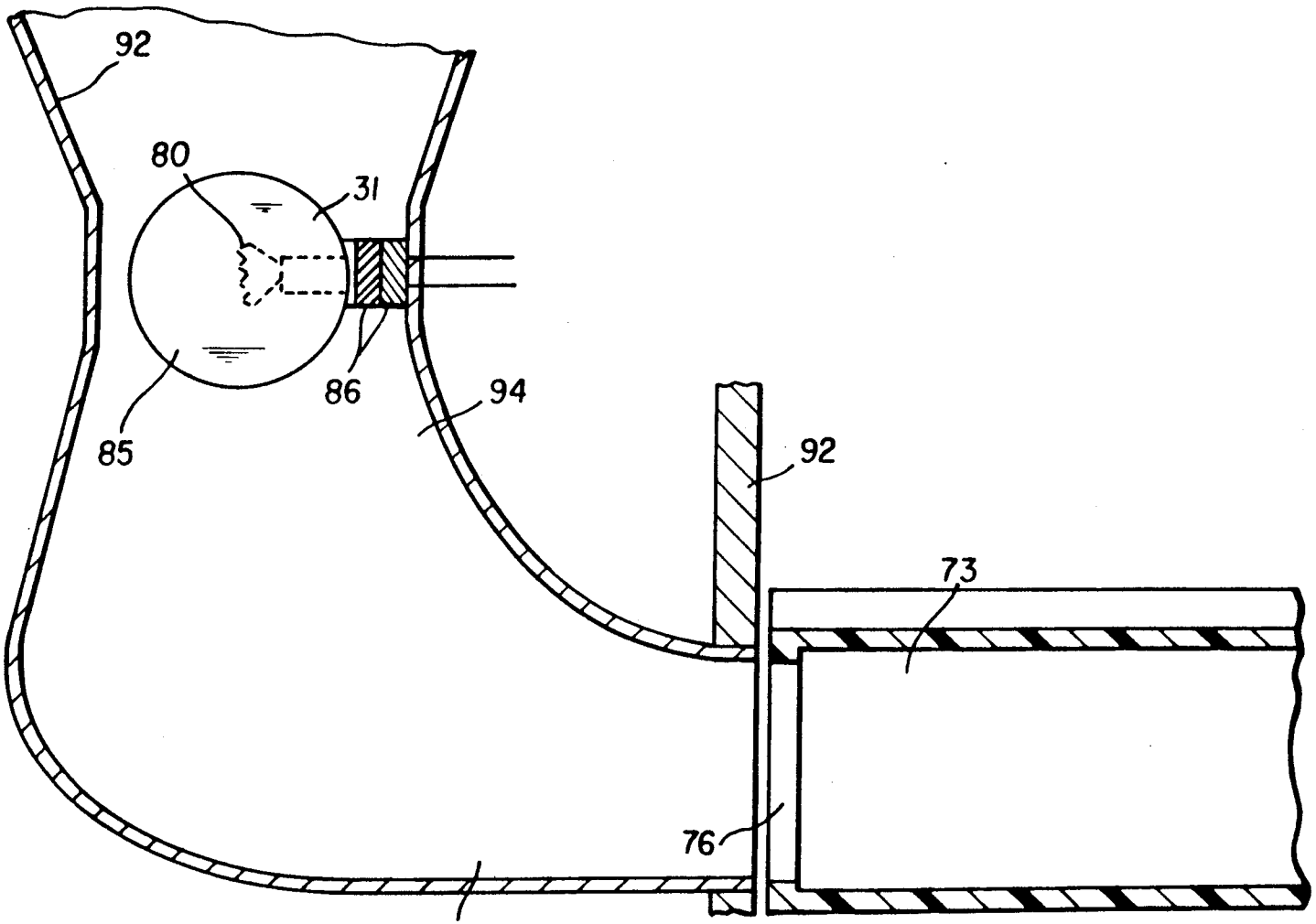
FIG. 5 is a left section of a portion of the apparatus shown in FIG. 4.

According to FIGS. 3–5, charger 4 includes a corona generating source, for example, a corona wire 25 mounted within a metallic shield 72 which partially encloses wire 25. The metallic shield includes an opening 74 which can be a series of holes or a single long hole, as shown and described later with respect to FIGS. 6 and 7. Opening or openings 74 open into a cartridge air channel 73 generally surrounding the side of shield 72 opposite corona wire 25 and bounded by a portion of the housing of cartridge 3. Cartridge air channel 73 includes a cartridge channel exit 76 through which air can move from opening 74. When cartridge 3 is received in image forming apparatus 1 and mounted as described with respect to FIG. 2, opening 76 mates with a complimentary opening to a receiving apparatus air channel 32, best seen in FIG. 5. Receiving apparatus air channel 32 is defined by polished aluminum walls 92 that define a path for air from charger 4, which path has a substantial vertical portion 94 to an exit 96 (see FIG. 4). A heating means is located in the vertical portion 94 of channel 32. For example, a polished aluminum sphere 32 containing a thermal storage medium 85, for example, containing glycerine or water or some other material with a high specific heat, is mounted within vertical portion 94 of channel 32. A resistance heater 80 is positioned within the thermal storage medium 85 and is connected through conduction breakers 86 to a suitable source of electrical power, which connection also includes sufficient structural strength to support sphere 31 containing storage medium 85. Alternatively, the thermal storage medium can be a high specific heat wax in a spherical shape, both to fit the receiving apparatus air channel 32 and to be slow in losing heat after resistance heater 80 is turned off.

During operation of charger 4, resistance heater 80 is activated to heat thermal storage medium 85. Heat from storage medium 85 heats air in channel 32 which rises to exit 96 followed by air entering cartridge air channel 73 through opening 74 which ventilates the area around wire 25 and shield 72. Air entering cartridge channel 73 through opening 74 may originate from air entering the cartridge through the development, transfer or laser openings 15, 16 or 17. If the cartridge is particularly tight to drum 2, it may be desirable to place an additional air intake 37 in the sidewall of the cartridge, as seen in FIG. 3.

Figure 6:
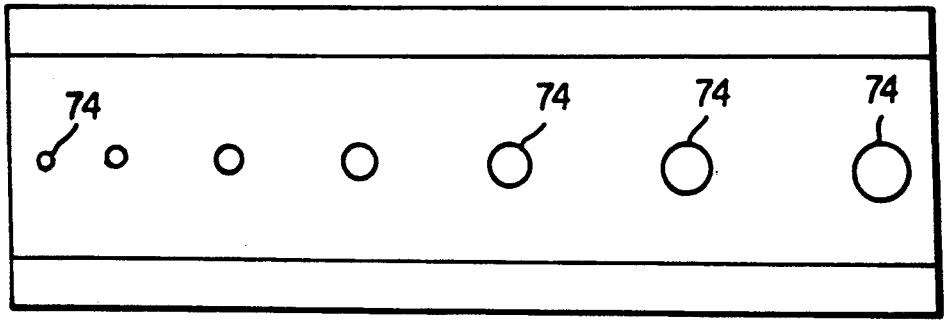
FIGS. 6 and 7 illustrate alternative embodiments of openings to a charger portion of the apparatus shown in FIG. 2.
Figure 7:
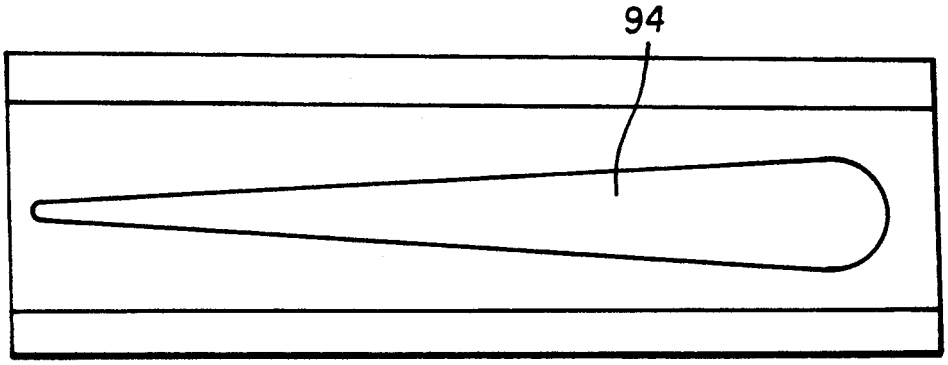

As seen in FIGS. 6 and 7, to properly even the flow of air across the length of corona wire 25, it is desirable to compensate for the closeness of one end of the charger to receiving apparatus channel 32. This is accomplished by either making individual holes, as shown in FIG. 6, that are smaller next to the exit 76 and larger remote from exit 76 or by creating a single opening, as shown in FIG. 7, which tapers in the same direction.

Figure 8:
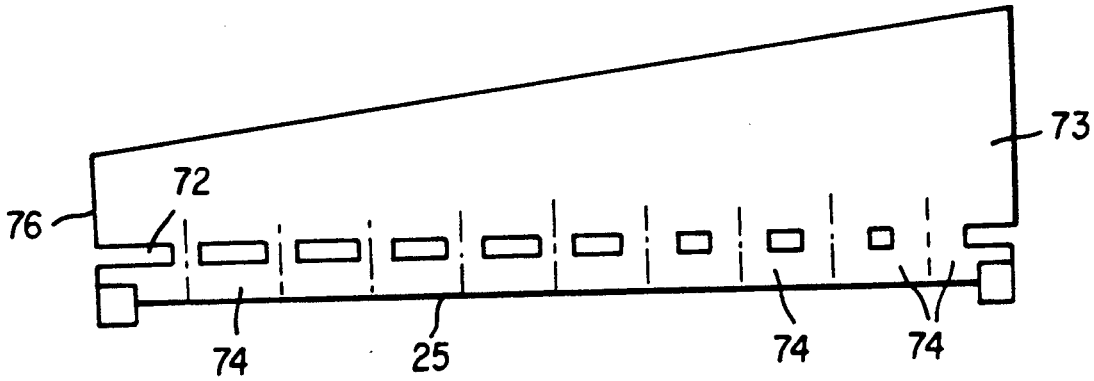
FIG. 8 is a schematic top section illustrating an alternative shape for a cartridge air channel portion of the apparatus shown in FIG. 2.

FIG. 8 is a top view of another feature of cartridge air channel 73 and shield openings 74 that can be advantageously used. In FIG. 8, the channel 73 is larger itself at an end remote from opening 76. This is cooperative with larger openings 74 at that remote end to even air flow through the openings (as in FIG. 6).

Polished aluminum air channel walls 92 can be formed by independent aluminum tubing separately mounted in the apparatus or can be formed as part of the housing of the apparatus itself and connected to a receiving apparatus wall 92. Polished aluminum is preferred for the interior walls to prevent the escape of radiant energy from channel 32. Thermal storage medium 85 is picked to have a high specific heat so that after power has been terminated to the apparatus, including resistance heater 80, the storage medium will maintain its temperature. This facilitates the ventilation of the charger by convection for a substantial period of time after the apparatus has been turned off. The spherical shape of sphere 31 reduces conduction heat loss during this time to extend the ventilation time. With appropriate sizing of sphere 31 and appropriate choice of materials, the heat capacity of sphere 31 can be made so that substantial ventilation will continue to take place well after an hour after shutdown of the machine, thereby continuing to ventilate the charger even though the machine is not in operation. This provides a substantial advantage over either the use of fans or other structures such as rotation of the drum or other elements dependent upon connection of electrical power to the image forming apparatus 1.

The invention has been described in detail with particular reference to a preferred embodiment thereof, but it will be understood that variations and modifications can be effected within the spirit and scope of the invention as described hereinabove and as defined in the appended claims.

I claim:

1. Image forming apparatus including a corona generating source, means partially enclosing said corona generating source and means for ventilating said corona generating source, characterized in that said ventilating means includes:

means defining an opening in said enclosing means, means defining an air channel from said opening to an exit location, said channel being shaped to define a path for air from said opening to said exit, said exit being higher than said opening, and means for heating air in said channel to cause movement of air from said opening to said exit to ventilate said corona source, said heating means being located in said channel and including a thermal storage medium having a high specific heat and means for heating said thermal storage medium, said thermal storage medium having sufficient thermal capacity to maintain its temperature to ventilate said corona generating source after said means for heating said thermal storage medium has been turned off.

2. Image forming apparatus according to claim 1 wherein said thermal storage medium is of sufficient heat capacity to ventilate said corona generating source for at least one hour after said means for heating said thermal storage medium has been turned off.

3. Image forming apparatus according to claim 1 wherein said thermal storage medium is contained in a container which is spherical in shape.

4. Image forming apparatus according to claim 1 wherein said means for heating said thermal storage medium is a resistance heater.

5. Image forming apparatus according to claim 4 wherein said thermal storage medium is a liquid contained in a metallic sphere and said resistance heater is immersed in said liquid.

6. Image forming apparatus according to claim 1 wherein at least the heated portion of said channel is defined by radiation reflective walls.

7. Image forming apparatus including: an image member cartridge including, an image member mounted for rotation past a series of stations, a charger for applying a uniform charge to said image member, means for receiving said image member cartridge in said image forming apparatus, characterized in that said cartridge includes means defining an opening to said charger, and means defining a cartridge air channel from said opening to a cartridge channel exit, further characterized in that said cartridge receiving means includes a receiving means air channel position to define an air path from a receiving means channel entrance to a receiving means channel exit, which receiving means channel exit is above said receiving means channel entrance and which entrance is positioned to mate with said cartridge air channel exit when the cartridge is received in said receiving means, said receiving means air channel including means for heating air in said channel to cause movement of air from said charger opening to said receiving means channel exit to ventilate the charger, said heating means being located in said channel and including a thermal storage medium having a high specific heat and means for heating said thermal storage medium, said thermal storage medium having sufficient thermal capacity to maintain its temperature to ventilate said corona generating source after said means for heating said thermal storage medium has been turned off.

* * * * *